US007647705B2

(12) United States Patent
Rosso et al.

(10) Patent No.: US 7,647,705 B2
(45) Date of Patent: Jan. 19, 2010

(54) T-SQUARE WITH FINGER GUARD

(75) Inventors: Aaron Charles Rosso, Chicago, IL (US); Amar Arvind Patel, South Barrington, IL (US); Matthew Earle Myers, Naperville, IL (US); Scott Fong, Causeway Bay (HK)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 11/937,294

(22) Filed: Nov. 8, 2007

(65) Prior Publication Data

US 2009/0119939 A1 May 14, 2009

(51) Int. Cl.
*B43L 7/02* (2006.01)

(52) U.S. Cl. ..... 33/479; 33/474

(58) Field of Classification Search ..... 33/474, 33/479, 480, 484, 485
See application file for complete search history.

(56) References Cited

U.S. PATENT DOCUMENTS

| | | | | | |
|---|---|---|---|---|---|
| 285,404 | A | | 9/1883 | Gardam | |
| 566,195 | A | * | 8/1896 | Leavitt | 33/485 |
| 1,082,626 | A | | 12/1913 | Foerst | |
| 2,200,019 | A | | 5/1940 | Boehme | |
| 2,307,892 | A | * | 1/1943 | Lowther | 33/485 |
| 2,724,184 | A | | 11/1955 | Spear, Jr. | |
| 3,394,457 | A | | 7/1968 | Holder | |
| 4,060,902 | A | * | 12/1977 | Keller | 33/403 |
| 4,186,493 | A | | 2/1980 | Khan et al. | |
| 4,279,081 | A | | 7/1981 | Wing et al. | |
| 5,033,197 | A | | 7/1991 | Irvello | |
| 5,231,764 | A | | 8/1993 | Chang | |
| D376,988 | S | | 12/1996 | Bruno | |
| 5,615,488 | A | * | 4/1997 | Brady | 33/484 |
| 5,732,472 | A | | 3/1998 | Praye | |
| 5,842,402 | A | * | 12/1998 | Collier | 33/484 |
| 5,873,171 | A | * | 2/1999 | Hsu | 33/484 |
| 6,851,201 | B1 | * | 2/2005 | Gioia et al. | 33/479 |
| 6,973,733 | B2 | * | 12/2005 | Levine | 33/484 |
| 2002/0095804 | A1 | * | 7/2002 | Coplan | 33/484 |

OTHER PUBLICATIONS

Stanley Maxstick—45-103-48"— Straight Edge Website Printout, 2002, (2 pages).

* cited by examiner

*Primary Examiner*—G. Bradley Bennett
(74) *Attorney, Agent, or Firm*—Greer, Burns & Crain, Ltd.; David Janci, Esq; Pradip Sahu, Esq.

(57) ABSTRACT

A finger guard for use with a T-square having a head and a blade includes an elongated body, two finger-shielding surfaces extending along a longitudinal axis of said body for accommodating an installer's thumb, a lower edge on the body that is attachable to the blade of the T-square, and a peak edge opposite the lower edge and separating upper ends of the surfaces.

17 Claims, 4 Drawing Sheets

T-SQUARE WITH FINGER GUARD

BACKGROUND

The present invention relates to straight edges used as cutting guides, and more specifically to T-squares used in the installation of building panels such as wallboard.

In the construction industry, during the installation of building panels such as gypsum wallboard or the like, installers often need to cut the panels into sizes smaller than the standard 4×8 foot size. To obtain a straight edge on the cut panel, installers traditionally employ metal T-squares. Generally, installers set a sheet of wallboard upright with the rough side facing the installer and place a head of the T-square upon a top edge of the panel. In most cases, the head is oriented horizontally. Next, the typically vertically oriented blade of the T-square is aligned with the line to be cut. The installer then steadies the T-square in position with one hand and with the opposite foot or knee resting against a lower portion of the blade, and runs a utility knife along the side of the T-square from top to bottom to score the cut. After scoring and removing the T-square, the installer applies impact pressure or simply kicks the score to "snap" the drywall. This ensures a clean edge. In some cases, the installer runs the utility knife along the back of the drywall sheet to finish the cut.

When using the guiding edge of conventional T-squares, the user applies an inward lateral pressure to keep the knife against the guide edge. In some cases, this causes the knife to jump over the edge towards the user's hand holding the T-square in position. There have been instances of user's hands being cut due to these knife jumps.

To reduce incidents of such cuts, some installers have fastened a full-length L-shaped metal bracket in the middle of the T-square blade to help guard against accidental knife jumps. Although this design offers added protection to the installer's hand, the raised body of the bracket on the lower two-thirds of the T-square creates an obstacle for users trying to stabilize the bottom of the T-square with their foot or knee. Furthermore, depending on the orientation of the assembly, the full length L-shape design creates a bias for either right or left-handed users. In addition, in some cases the conventional L-brackets obscure the numerical indicia on the T-square, or are uncomfortable for extended use.

BRIEF SUMMARY OF THE INVENTION

The aforementioned drawbacks of the prior art are addressed by the present T-square having an attached ergonomic finger guard for providing a barrier between the cutting blade and the installer's hand. To comfortably fit the natural contours of a user's thumbs, the finger guard is designed with ergonomically shaped sides. In addition, the symmetrical configuration of the present finger guard facilitates ease of assembly and use by either right or left-handed users. To avoid interfering with support and/or stabilization by an installer's foot, the present finger guard extends at most two-thirds of the length of the T-square blade. The lower portion of the blade that is free of the guard allows the user to stabilize the present T-square with the knee or foot.

A finger guard for use with a T-square having a head and a blade includes an elongated body, two finger-shielding surfaces extending along a longitudinal axis of the body for accommodating an installer's thumb, a lower edge on the body that is attachable to the blade of the T-square, and a peak edge opposite the lower edge and separating upper ends of the surfaces.

In another embodiment, a T-square used as a straight edge for cutting building panels includes a head joined perpendicularly to a blade, a finger guard having an elongated body, two concave finger-shielding surfaces extending a full length of the body, a flat lower edge and a peak edge opposite the lower edge. The body includes at least one fastening formation and at least one boss, the body is attached to an indicia surface of the blade and extends longitudinally toward an axial end of the blade. At least one hole in the blade is provided for engaging a corresponding one of the at least one fastening formations to secure the finger guard to the indicia surface. Also, at least one aperture is provide in the blade for engaging a corresponding one of the at least one boss to locate and align the finger guard on the indicia surface.

In still another embodiment, a T-square used as a straight edge for cutting building panels includes a head joined perpendicularly to a blade, a finger guard having a body that is bilaterally symmetrical along a longitudinal axis. The body extends at most ⅔ of a length of the blade, the guard having two concave finger-shielding surfaces extending a full length of the body. Also included on the guard is a flat lower edge, a peak edge opposite the lower edge, a pair of ramped surfaces joining the peak edge to the lower edge at respective ends of the body. The lower edge is attached flush against an indicia surface of the blade. A plurality of holes, countersunk or counterbored on a non-indicia surface of the blade, are constructed and arranged to be aligned with fastening formations on the body for securing the finger guard to the indicia surface of the blade. Additionally, a plurality of apertures is provided for engaging bosses depending from the body for locating the finger guard on the indicia surface of the blade.

DETAILED DESCRIPTION OF THE INVENTION

Figure 1:
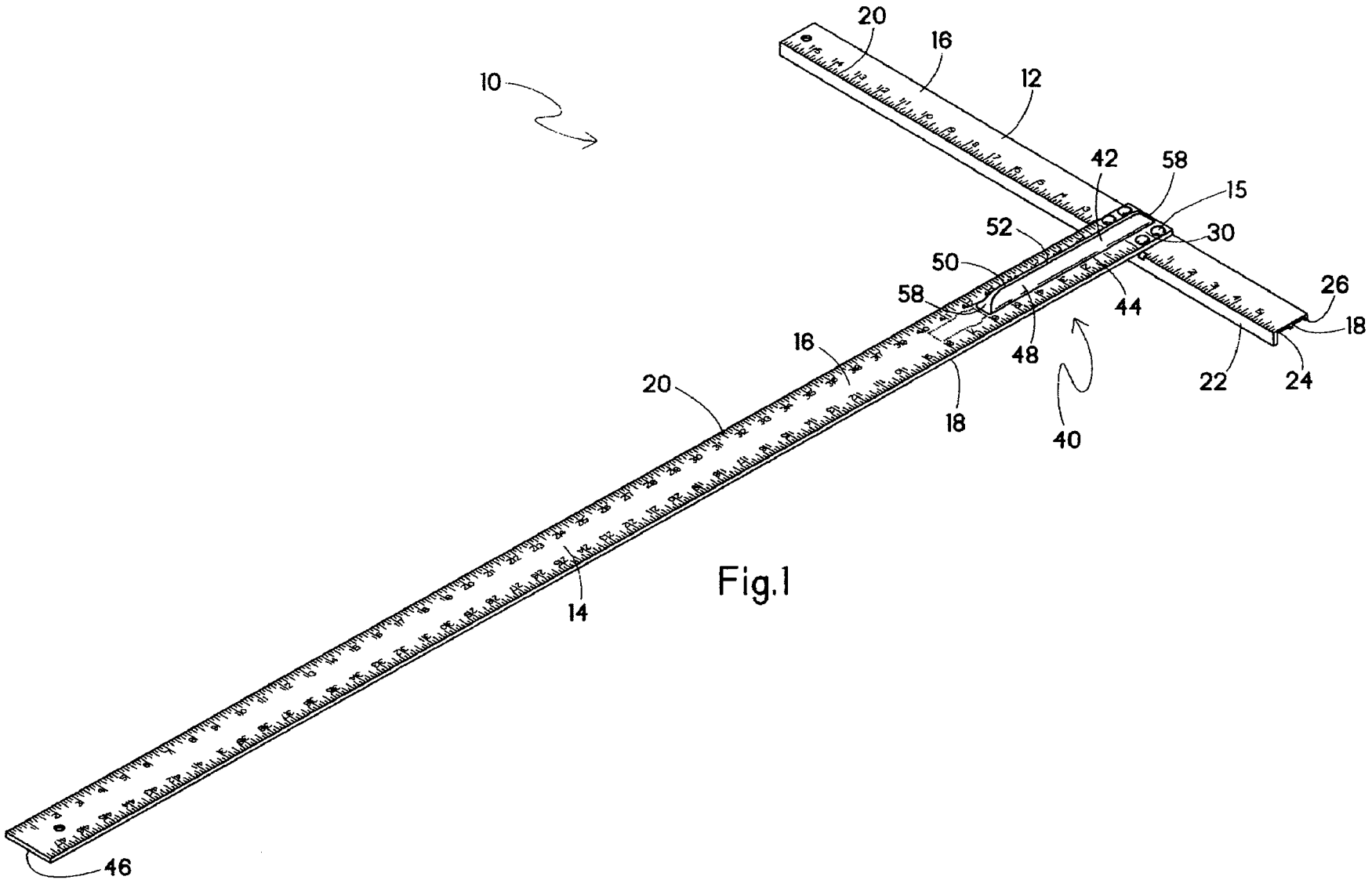
FIG. 1 is a top perspective view of the present T-square.
Figure 2:
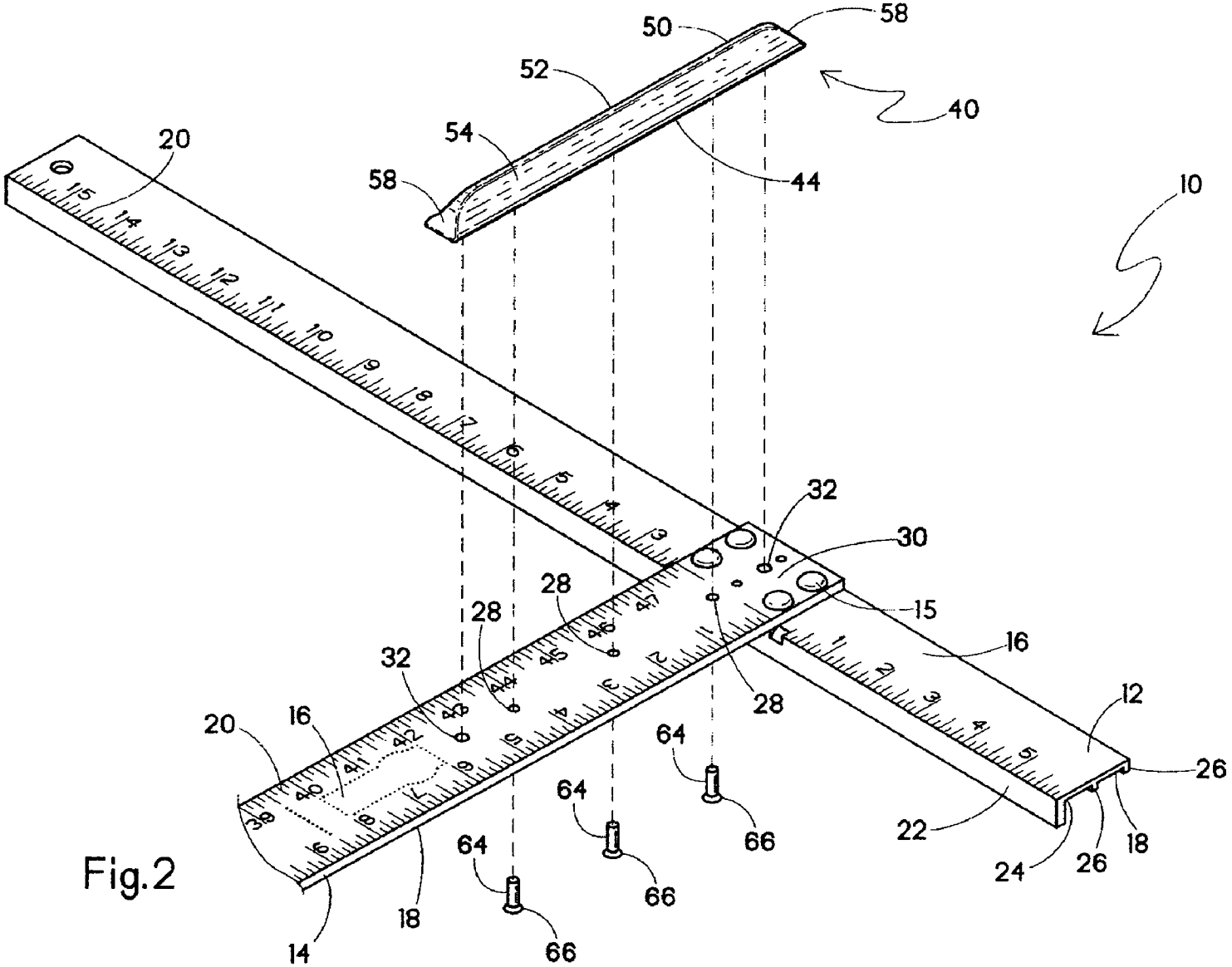
FIG. 2 is an exploded perspective view of the T-square of FIG. 1.

Referring now to FIGS. 1 and 2, the present T-square is generally designated 10 and is formed by perpendicularly joining a head 12 to a blade 14. Fasteners 15 are used to join the head 12 to the blade 14. The head 12 varies in length, but is typically shorter than the blade 14, which preferably ranges between 48" and 54" in length to correspond to standard widths of construction panels such as gypsum wallboard. As is well known in the art, head 12 and the blade 14 each have one indicia surface 16 and one non-indicia surface 18. Each respective indicia surface 16 has measurement marks 20 along outside edges.

A lip 22, used for locating and aligning the T-square on the edge of a work surface, is joined perpendicularly on an inner edge 24 of the head 12 and extends rearwardly from the non-indicia surface 18 oriented as shown in FIG. 1. Similarly, one or more ribs 26 are also joined perpendicularly with the head 12 and also extend rearwardly from the non-indicia surface 18 of the head 12. In the preferred embodiment, the lip 22 and the ribs 26 are in spaced, parallel relationship to each other.

Figure 3:
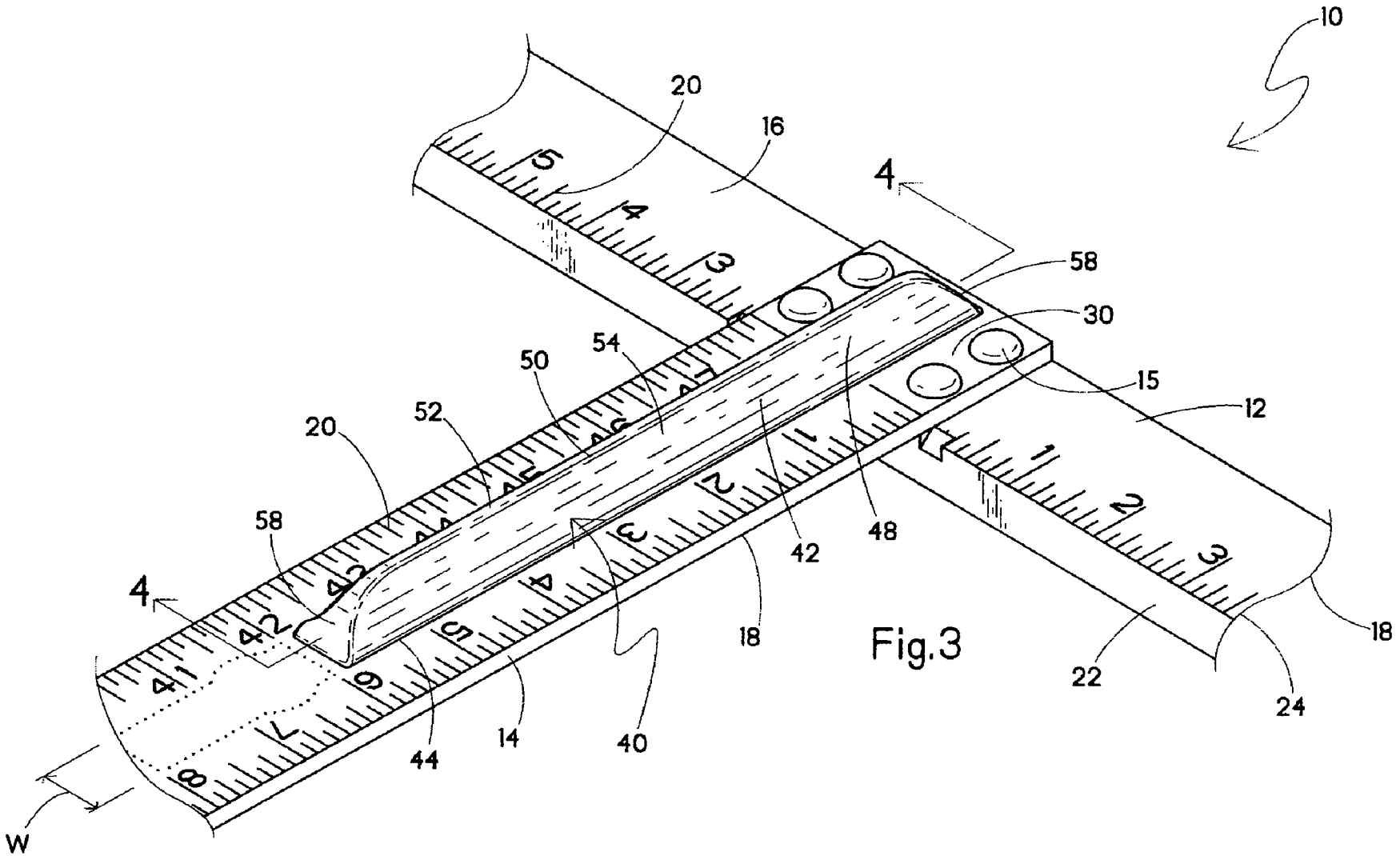
FIG. 3 is an enlarged top perspective view of the present finger guard on the present T-square.
Figure 3A:
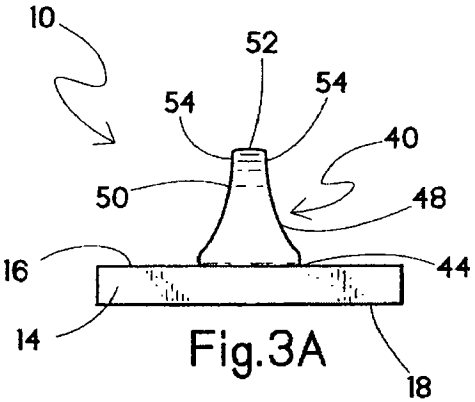
FIG. 3A is an end view of the present finger guard on the present T-square.
Figure 4:
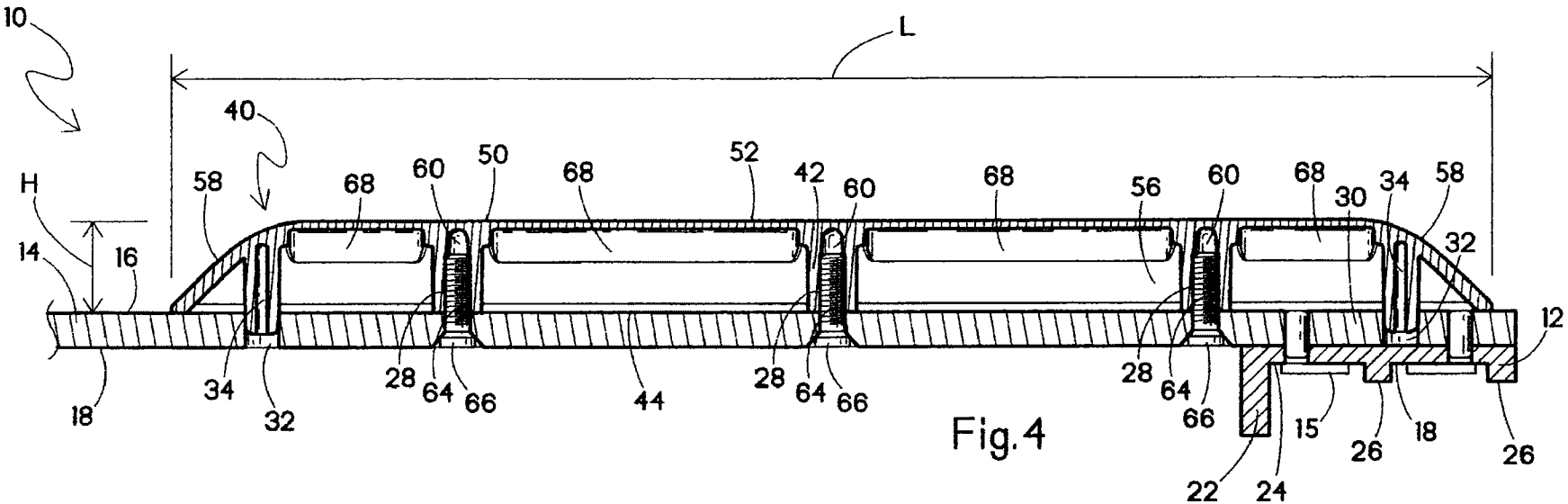
FIG. 4 is a cross-section taken along the line 4-4 in FIG. 3 in the direction generally indicated.

Referring now to FIGS. 2-4, to secure one or more finger guards to the indicia surface 16, one or more holes 28 are linearly aligned along the long axis of the blade 14. To maintain a flat surface on the non-indicia surface 18 of the T-square 10, the holes 28 are countersunk or counterbored on the non-indicia surface 18 to accommodate suitable fasteners in a countersunk orientation. In addition, these holes 28 are distally located from a junction 30 of the head 12 and the blade 14 to facilitate removal of a finger guard. Three holes 28 are used in the preferred embodiment, however, the number, positioning, and configuration of the holes 28 may vary to suit the application. Additionally, the blade 14 has one or more apertures 32 constructed and arranged to engage bosses 34 depending from a finger guard, generally designated 40. Two apertures 32, one at each longitudinal or axial end of the finger guard 40, are preferred to receive the bosses and locate and align the guard on the indicia surface 16. The bosses 34 provide support to the finger guard 40 against laterally directed forces received at upper and lower ends of the guard.

Referring now to FIGS. 1-4, the ergonomic finger guard 40 has an elongated body 42 with a flat lower edge 44 that is attached flush against the indicia surface 16 of the blade 14 and extends toward an axial or longitudinal end 46 of the blade 14. Preferably, the guard 40 is made of molded ABS blend plastic, but other durable plastics, or materials such as zinc, aluminum, or wood may also be used. An important feature of the present guard 40 is that it is bilaterally symmetrical along its longitudinal axis and has two, preferably identical concave finger-shielding surfaces 48, 50 preferably extending the full length of the body 42 to accommodate either the right or left thumb depending on the preference of the installer. Thus, this configuration allows for the guard 40 to be used ambidextrously.

In addition to the concave finger-shielding surfaces 48, 50 and the flat lower edge 44, the guard 40 has a peak edge 52 opposite the lower edge 44 and separating upper ends 54 of the shielding surfaces. A hollow interior chamber 56 is defined by the surfaces 48, 50, the peak edge 52 and the lower edge 44. The lower edge 44 is joined to the peak edge 52 by a ramped surface 58 to provide a smooth transition between the peak edge and the lower edge for enhanced ergonomics and to avoid user exposure to sharp edges. Preferably, the interior chamber 56 of the guard 40 is hollow, although a solid interior is contemplated.

While other dimensions are contemplated depending on the application, a preferred height H (FIG. 4) of the peak edge 52 is ½" (1.27 cm) and a preferred length L (FIG. 4) of the guard 40 is 7½" (19.05 cm). The ratio of the height H to the length L is less than 1.0. The height H preferably ranges between ¼" and 1½" (0.625 cm and 3.81 cm), and the length L is preferably between 3" and 36" (7.62 cm and 91.44 cm).

To allow an installer to place a knee or foot on the T-square 10 for stabilization during cutting or scoring of a building panel, the length L of the finger guard 40 is at most two-thirds of the length of the blade 14 of the T-square 10. Preferably, the above-identified range in the length L is approximately no more than 30" (76.2 cm) on a 48" (121.92 cm) T-square and no more than 36" (91.44 cm) on a 54" (137.16 cm) T-square. Such a configuration leaves a significant portion of the blade 14 upon which the installer may place a foot or knee without discomfort. Moreover, the configuration of the guard 40 and the T-square 10 does not detract from its protective function during the scoring or cutting of building panels, as the majority of knife jumps occur during the first few inches of a cut due to the uncertain path of the knife.

While other widths W are contemplated, a preferred width (FIG. 3) of the guard 40 is ⅝" (1.5875 cm) so that the measurement marks 20 on the indicia surface 16 of the blade 14 are visible for measurement purposes upon installation of the guard on the blade.

Referring now to FIG. 4, to secure the guard 40 flush against the indicia surface 16 of the blade 14, the guard has at least one and preferably a plurality of fastening formations 60, linearly aligned along the longitudinal axis of the body 42 and extending from an inside surface 62 of the peak edge 52 to a point even with the lower edge 44. Such fastening formations 60 are internally threaded and aligned with the linearly disposed holes 28 on the T-square 10. The formations 60 are threadably engaged by fasteners 64 such that heads 66 of the fasteners are flush with the non-indicia surface 16. The bosses 34 depend from the inside surface 62 and extend past the lower edge 44 and are constructed and arranged to engage the apertures 32 on the blade 14 of the T-square 10 to properly locate and align the finger guard 40 prior to insertion of the fasteners 64. As is known in the molding art, at least one core out void 68 is provided to facilitate molding of the peak edge 52 to prevent warping of the guard 40.

As disclosed above, the present T-square 10 features a guard that accommodates right or left-handed users. Furthermore, the present T-square 10 not only offers protection against knife jumps, but also allows for a user to enhance stability by providing a section of the blade upon which the user may place a knee or foot while scoring a wallboard panel or other construction panel.

While a particular embodiment of the present T-square with finger guard has been described herein, it will be appreciated by those skilled in the art that changes and modifications may be made thereto without departing from the invention in its broader aspects and as set forth in the following claims.

What is claimed is:

1. A finger guard for use with a T-square having a head and a blade comprising:

an elongated body;

two finger-shielding surfaces extending along a longitudinal axis of said body for accommodating an installer's thumb;

a lower edge on the body that is attachable to the blade of the T-square; and a peak edge opposite the lower edge and separating upper ends of said surfaces.

2. The finger guard of claim 1, wherein said finger-shielding surfaces are concave.

3. The finger guard of claim 1, wherein said body is bilaterally symmetrical along a longitudinal axis.

4. The finger guard of claim 1, wherein said finger-shielding surfaces extend a full length of said body.

5. The finger guard of claim 1, wherein said lower edge attaches flush with an indicia surface of the blade.

6. The finger guard of claim 1, wherein said body has at least one fastening formation extending to a point even with said lower edge for attaching said body to the blade.

7. The finger guard of claim 6, further including a plurality of said at least one fastening formations which are aligned linearly along a longitudinal axis of said body.

8. The finger guard of claim 1, wherein at least one boss for locating and aligning said guard on the blade of the T-square, depends from an inside surface of said peak edge and extends past said lower edge.

9. The finger guard of claim 1, wherein said peak edge is joined to said lower edge at each axial end of said body by a ramped surface.

10. A T-square used as a straight edge for cutting building panels, comprising:

a head joined perpendicularly to a blade;

a finger guard having an elongated body, two concave finger-shielding surfaces extending a full length of said body, a flat lower edge, a peak edge opposite said lower edge, said body including at least one fastening formation and at least one boss, said body attached to an indicia surface of said blade and extending longitudinally toward an axial end of said blade;

at least one hole in said blade for engaging a corresponding one of said at least one fastening formation to secure said finger guard to said indicia surface; and at least one aperture in said blade for engaging a corresponding one of said at least one boss to locate and align said finger guard on said indicia surface.

11. The T-square of claim 10, wherein a length of said finger guard is at most ⅔ of a length of said blade.

12. The T-square of claim 10, wherein said finger guard is attached flush against said indicia surface of said blade.

13. The T-square of claim 10, wherein said body is bilaterally symmetrical along a longitudinal axis.

14. The finger guard of claim 10, wherein said at least one hole has a countersunk end opposite said indicia surface.

15. The T-square of claim 14, wherein said at least one hole is distally located from a junction of said blade and said head.

16. The T-square of claim 10, wherein said peak edge of said finger guard is connected to said lower edge at each axial end of said body by a ramped surface.

17. A T-square used as a straight edge for cutting building panels, comprising:

a head joined perpendicularly to a blade;

a finger guard having a body that is bilaterally symmetrical along a longitudinal axis, extending at most ⅔ of a length of said blade, said guard having two concave finger-shielding surfaces extending a full length of said body, a flat lower edge, a peak edge opposite said lower edge, a pair of ramped surfaces joining said peak edge to said lower edge at respective ends of said body, said lower edge attached flush against an indicia surface of said blade;

a plurality of holes, countersunk on a non-indicia surface of said blade, constructed and arranged to be aligned with fastening formations on said body for securing said finger guard to said indicia surface of said blade; and a plurality of apertures for engaging bosses depending from said body for locating said finger guard on said indicia surface of said blade.

* * * * *